US008220772B2

(12) United States Patent
Schwoerer

(10) Patent No.: US 8,220,772 B2
(45) Date of Patent: Jul. 17, 2012

(54) ANCHOR ROD ANCHOR SYSTEM OF A CONCRETE WALL FORM

(75) Inventor: Artur Schwoerer, Senden (DE)

(73) Assignee: PERI GmbH, Weissenhorn (DE)

( * ) Notice: Subject to any disclaimer, the term of this patent is extended or adjusted under 35 U.S.C. 154(b) by 425 days.

(21) Appl. No.: 12/449,145

(22) PCT Filed: Jan. 23, 2008

(86) PCT No.: PCT/DE2008/000116

§ 371 (c)(1),
(2), (4) Date: Jul. 24, 2009

(87) PCT Pub. No.: WO2008/089737

PCT Pub. Date: Jul. 31, 2008

(65) Prior Publication Data

US 2010/0059655 A1 Mar. 11, 2010

(30) Foreign Application Priority Data

Jan. 27, 2007 (DE) ..... 10 2007 004 226

(51) Int. Cl.
*E04G 17/065* (2006.01)
*E04G 11/08* (2006.01)

(52) U.S. Cl. ..... 249/40; 249/216

(58) Field of Classification Search ..... 249/40, 249/42, 43, 213, 216, 190
See application file for complete search history.

(56) References Cited

U.S. PATENT DOCUMENTS

| | | | | | |
|---|---|---|---|---|---|
| 842,722 | A * | 1/1907 | Swinnerton | 249/43 |
| 1,176,255 | A * | 3/1916 | Spaulding | 249/42 |
| 1,293,344 | A * | 2/1919 | Colt | 249/42 |
| 1,424,880 | A * | 8/1922 | Colt | 249/40 |
| 2,069,085 | A * | 1/1937 | Day | 249/42 |
| 2,116,597 | A * | 5/1938 | Colt | 249/42 |
| 2,172,461 | A * | 9/1939 | Whitescarver | 249/213 |
| 2,503,494 | A * | 4/1950 | Keith | 249/43 |
| 2,574,274 | A * | 11/1951 | McMullan | 249/42 |
| 2,583,962 | A * | 1/1952 | Neptune | 249/40 |
| 2,659,125 | A * | 11/1953 | Williams | 249/42 |
| 3,328,055 | A * | 6/1967 | Lang | 249/42 |
| 3,357,672 | A * | 12/1967 | Capek | 249/216 |
| 3,360,232 | A * | 12/1967 | Vandenheuvel | 249/213 |
| 3,614,052 | A * | 10/1971 | Babbage | 249/213 |
| 5,332,189 | A * | 7/1994 | Tseng | 249/40 |
| 7,152,843 | B2 * | 12/2006 | Ward et al. | 249/216 |
| 7,934,693 | B2 * | 5/2011 | Bravinski | 249/40 |

FOREIGN PATENT DOCUMENTS

| | | |
|---|---|---|
| DE | 31 22 873 | 1/1983 |
| DE | 31 32 873 | 1/1983 |
| DE | 94 12 556 | 10/1994 |

(Continued)

*Primary Examiner* — Michael Safavi
(74) *Attorney, Agent, or Firm* — Paul Vincent

(57) ABSTRACT

A locking device (20,21) for an anchor rod (2) of an anchor system of a concrete wall form, has a screw nut element for screwing the anchor rod through a screw thread of the screw nut element. A dome plate can be fastened to a back of a form element (5,6) of the concrete wall form by means of fastening elements (30) and has a spherically shaped plate section with an opening in which the screw nut element is arranged so as to have radial play. The screw nut element has a groove-type radial seat which accommodates the edges of the opening in the spherical plate sections.

12 Claims, 5 Drawing Sheets

FOREIGN PATENT DOCUMENTS

| | | |
|---|---|---|
| DE | 197 54 366 | 6/1999 |
| DE | 103 36 414 | 3/2005 |
| EP | 0 279 046 | 8/1988 |
| GB | 1 158 041 | 7/1969 |
| GB | 1 416 021 | 12/1975 |
| JP | H6-79960 | 11/1994 |

* cited by examiner

ANCHOR ROD ANCHOR SYSTEM OF A CONCRETE WALL FORM

This application is the national stage of PCT/DE2008/00016 filed on Jan. 23, 2008 and also claims Paris Convention priority to DE 10 2007 004 226.6 filed on Jan. 27, 2007.

BACKGROUND OF THE INVENTION

The invention relates to an anchor system of a concrete wall form with at least one locking device for an anchor rod of the anchor system, wherein the locking device has a screw nut element for screwing the anchor rod through a screw thread of the screw nut element.

Such anchor systems are used in formwork for steel-reinforced concrete structures. Concrete wall forms are made up of a formwork shell and its supporting elements, for example, longitudinal girders and tie beams. The two sides of a wall are each formed from one concrete form element, that is, a half-form, which are held together by anchor rods. The anchor rods are inserted through holes in the formwork shell and fixed at their ends to the elements supporting the formwork shell in such a way that the tensile force exerted on the anchor rods during concrete casting is held. Normally, the two ends of the anchor rods have threads onto which screw nuts are screwed as anchor fastenings. This determines the effective length of the anchor rod and therefore the thickness of the concrete wall. At the same time, the pressure exerted during concrete casting by the liquid concrete on the formwork shell is redirected via the screw nuts onto the anchor rods. The anchor rods are subject to tensile stress during this operation. Between the formwork shells, spacer elements are included in the volume of the concrete wall to be cast that can absorb the compressive forces that occur during concrete casting, it being ensured that these compressive forces do not influence the wall thickness in an unwanted way, that is, reduce it.

DE 197 54 366 C2 discloses an anchor system of a concrete wall form, in which a locking device is provided on one side of a concrete wall form. The locking device comprises a position fixture of a screw nut of the anchor system. The screw nut is fixed in position by locking screws fastened in a tie beam and extending transversely to the axis of the screw nut, preventing the screw nut fixed in position from being turned further. Due to the fastening of the locking screw on the tie beam, this position fixture also locks the screw relative to a half-form.

DE 103 36 414 B4 discloses an anchor system, wherein one very flexible locking device is provided on the rear of each of two form elements constituting a concrete wall form through which an anchor rod of the anchor system is inserted, by means of which both tensile and compressive forces exerted on the form elements can be held in such a way that the desired concrete wall thickness can be molded with precision.

With the known anchor systems, there are problems with inserting the anchor rod when the concrete wall form is erected, if the anchor insertion holes of the form elements with their formwork shells facing each other and forming the concrete wall are not sufficiently well-aligned opposite each other. Because the anchor rod is always inserted from the outside (as seen from the rear of a first form element) through the already erected form elements, the formwork erector who is positioning the anchor rod cannot see the anchor insertion hole of the second form element. The latter anchor insertion hole is found relatively easily but, with poorly aligned anchor insertion holes, the anchor rod extends obliquely with respect to the formwork shell of the form elements, making it very difficult to engage the thread of a locking device on the rear of the second form element. Moreover, if the anchor rod is oblique in this way, the locking devices cannot lie flat against the form elements around their entire circumference, which results in the forces that occur during concrete casting being transmitted to the locking devices concentrated at one point only, which places a heavy load on the locking devices.

DE 94 12 556 discloses a locking device for an anchor rod of an anchor system of a concrete wall form with a screw nut element for screwing the anchor rod, wherein a dome plate is provided that has a spherically formed plate section with an opening. The screw nut element is spherically shaped in such a way that it is held within the edges of the opening in a similar way to a ball-joint, in such a way that it can be moved, radial turning of the screw nut element in the opening being prevented by axial groove-type guides.

If the screw nut element is held in the dome plate in this way, the anchor rod screwed into the screw nut element can only move subject to very precise guidance. The dome plate therefore has to be exactly positioned relative to the anchor insertion hole in a formwork shell.

The object of the invention is to provide an anchor system for concrete wall forms, a locking device for the anchor system, and a concrete wall form that avoid the disadvantages of the prior art.

This object is solved by a locking device of an anchor system for concrete wall form elements, the anchor system having an anchor rod with an outer thread. The device comprises a fastening element cooperating with a back of a form element, a dome plate cooperating with the fastening element to fasten the dome plate to the back of the form element, the dome plate having a spherically shaved plate section defining an opening, a screw nut element having an inner opening with a screw thread for cooperation with the outer thread of the anchor rod, the screw nut element being disposed in the opening of the spherical plate section with radial play, the screw nut element defining a receptacle structured as a radial groove around an entire circumference thereof, the radial groove accepting edges of the spherical plate section opening and a tubular guidance facility aligned with the screw thread of the screw nut element and disposed at an end of the screw nut element facing a form element.

SUMMARY OF THE INVENTION

An inventive locking device for an anchor rod of an anchor system of a concrete wall form with a first and a second form element comprises a screw nut element for screwing the anchor rod through a screw thread of the screw nut element. According to the invention, a dome plate is provided that can be fastened by means of fastening elements to the back of one of the form elements of the concrete wall form, that is, the side of the form element usually having longitudinal and/or tie beams facing away from the formwork shell surface on the concrete side. The dome plate has a spherically shaped plate section with an opening, in which the screw nut element is arranged so as to have radial play. The screw nut element has a groove-type radial seat, which accommodates the edges of the opening in the spherical plate section. The radial play is provided all around so that, within the radial play, deflection of the screw nut element around the entire circumference on the dome plate is possible. This results in a pivot point of the screw nut element preferably comprising a domed cap nut in the region of the anchor insertion hole in the formwork shell. The radius of the spherical plate section is chosen to correspond to the distance between the formwork shell and the opening in the spherical plate section. The screw nut element can therefore be deflected on the dome plate in a similar way to a joystick.

When the inventive locking device is used in a concrete wall form, in which the form elements and therefore also the anchor insertion holes in the formwork shells are not directly aligned opposite each other, compressive forces exerted on the screw nut elements are transmitted radially from the dome surface to the screw nut elements through an area round the entire circumference even though the anchor rods are not perpendicular to the formwork shell surfaces. This ensures stable erection of the concrete wall form. Moreover, possible damage to an anchor system due to concentrated loading is avoided.

In a preferred embodiment, a tubular guidance facility aligned with the screw thread of the screw nut element is provided at the end of the screw nut element to be disposed on the concrete form side. This makes it easier to find the screw thread into which the anchor rod is to be screwed with the anchor rod. The inner surface of the tubular guidance facility can advantageously be constituted in the shape of a funnel. However, the cross-section of the opening of the guidance facility facing away from the screw nut element at least exceeds the cross-section of the screw thread of the screw nut element. The guidance facility ends in the region of the formwork shell plane so that the tip of an anchor rod is forced to enter the opening of the guidance facility when an anchor rod is inserted.

In an especially preferred embodiment, an anti-rotation lock is provided on the screw nut element. This anti-rotation lock can, for example, be achieved by constituting the surfaces of the screw nut element lying one upon the other and the dome plate with great anti-rotation friction, for example, by means of a studded surface. If such a locking device is used, the anchor rod, which, for example, can be screwed from the rear of the first form element into the locking device, which is fastened on the rear of the second form element, can be screwed in without a formwork erector on the rear of the second form element having to operate the locking device during screwing to prevent the screw nut element from rotating with the anchor rod. Such a locking device is therefore suitable, for example, for use in inaccessible regions of the concrete form.

The anti-rotation lock preferably has a stop element, wherein the stop element prevents rotation of the screw nut element by stopping on a stop preferably constituted by the fastening elements. This ensures especially simple and reliable securement against rotation. If the stop element is constituted as a wing, a stop located further away from the screw nut element can also prevent rotation.

An inventive anchor system of a concrete wall form comprises an anchor rod and a first and a second inventive locking device, wherein the anchor rod is screwed into the screw thread of the screw nut elements of the locking devices. Using such an anchor system, the advantages of the inventive locking device can be achieved on both sides of the concrete wall form.

The anchor rod preferably tapers toward the anchor rod tip, wherein a first screw thread in the end region of the anchor rod facing away from the anchor rod tip has a larger thread diameter than a second screw thread in the end region of the anchor rod near the anchor rod tip. The second screw thread near the anchor rod tip can thus be screwed into the second locking device as far as the stop, resulting in a defined position of the anchor rod and therefore of the second form element.

The anchor rod advantageously conically tapers between the first and the second screw thread, which facilitates removal of the anchor rod after a concrete wall cast between the concrete wall forms has cured.

On an inventive concrete wall form, at least one inventive anchor system is applied. The concrete wall form has a first and a second form element, wherein the formwork shells of the form elements are disposed facing each other. The first locking device of the anchor system is disposed on the rear of the first form element, preferably fastened by means of first fastening elements, and the second locking device of the anchor system is disposed on the rear of the second form element, preferably fastened by means of second fastening elements. The anchor rod of the anchor system, coming from the rear of the first form element, is screwed through the screw thread of the screw nut element of the first locking element, is guided through one anchor insertion hole in each of the formwork shells, and is screwed into the screw thread of the screw nut element of the second locking device. The inventive anchor system can be advantageously applied by first fastening the second locking device on the rear of the second form element, for example, by means of a screw bolt. The anchor rod is then screwed onto the first locking device that is already in the region of the end further away from the anchor rod tip, is guided through the form elements from the rear of the first form element, and is screwed into the screw nut element of the second locking device as far as it will go. After this, the first locking device is fastened to the adjacent form element. The fastening of the two locking devices on the rear of the form elements is not only for exact positioning of the latter but also to transmit the compressive forces exerted on the form elements when concrete is poured into the concrete wall form from the anchor system onto the anchor rod.

If a locking device with a tubular guidance facility and/or an anti-rotation lock is used as the second locking device, finding the screw thread of the second locking device is easier and/or the second locking device does not have to be held secure by a formwork erector to prevent the anchor rod from rotating during screwing.

In an inventive concrete wall form, an anchor system is very advantageously used, in which a first screw thread in the end region of the anchor rod facing away from the anchor rod tip has a larger thread diameter than a second screw thread in the end region of the anchor rod near to the anchor rod tip, preferably with an anchor rod that conically tapers. If the second screw thread of the anchor rod of the anchor system is screwed completely into the screw nut element of the second locking device of the anchor system as far as it will go and the screw nut element of the first locking device of the anchor system is secured by means of a locking splint inserted through a splint hole in the anchor rod, the wall thickness of the concrete wall to be cast can be set precisely without additional alignment work simply by final assembly of the anchor system.

A further inventive embodiment of the locking devices for fastening to the form element to be erected first could be to attach the locking device permanently to the form elements. This would have the advantage of obviating pre-assembly on the form element to be erected first. However, the fastening means would then have to be attached to the form elements in such a way that they could be slid to enable fastening of the anchor rod with the locking device screwed to it on the closing form side.

The invention is explained in more detail below based on an example embodiment and referring to the drawings.

DESCRIPTION OF THE PREFERRED EMBODIMENT

The figures of the drawings show the inventive object highly schematically and are not scale drawings. The individual parts of the inventive object are shown in such a way that their structure is clearly visible.

Figure 1A:
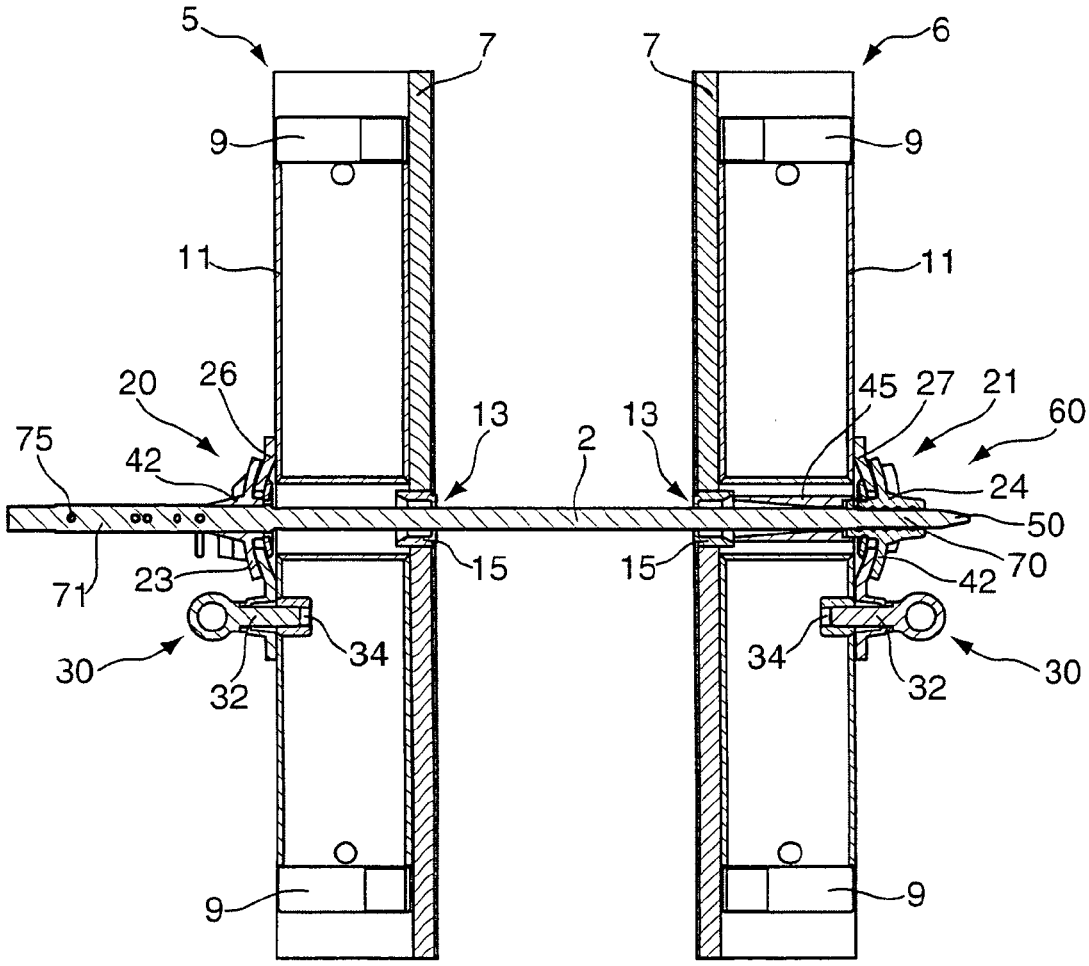
FIG. 1*a* shows an embodiment of an inventive concrete wall form in first phase of implementation of an anchor rod of an inventive anchor system in a cross-section through the inventive anchor system.
Figure 1C:
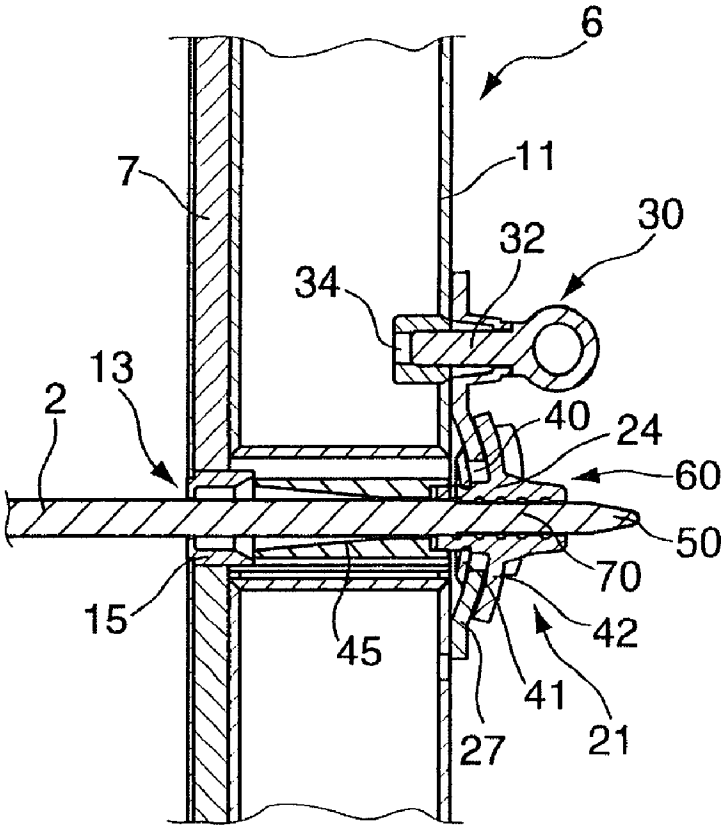
FIG. 1*c* shows a second enlarged detail of FIG. 1*a*.
Figure 1B:
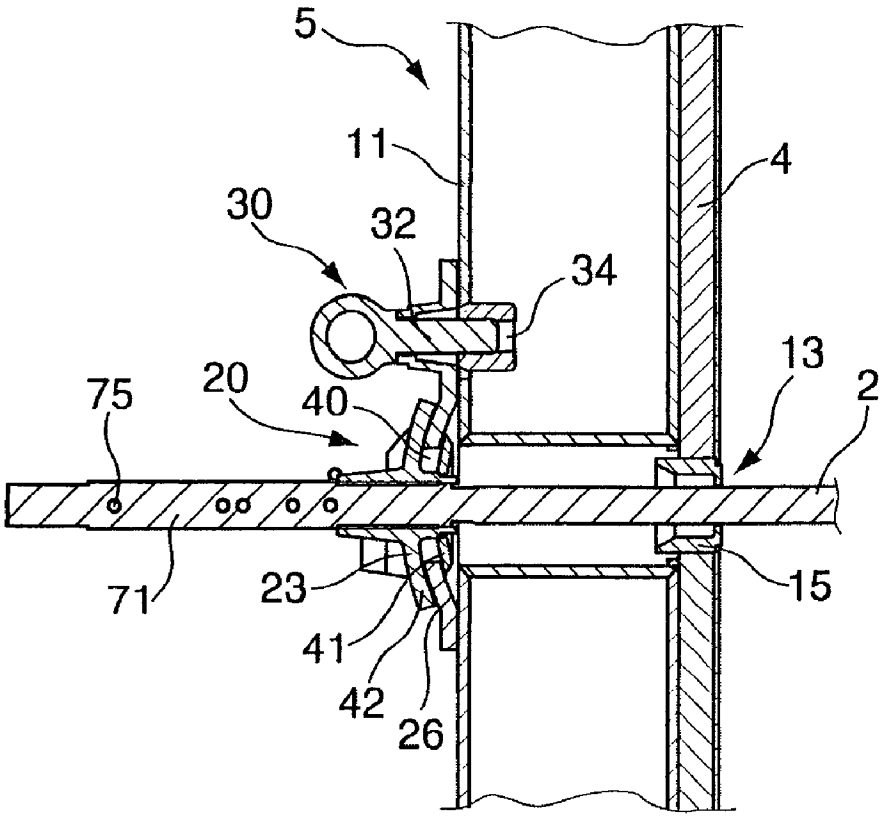
FIG. 1*b* shows a first enlarged detail of FIG. 1*a*.
Figure 2:
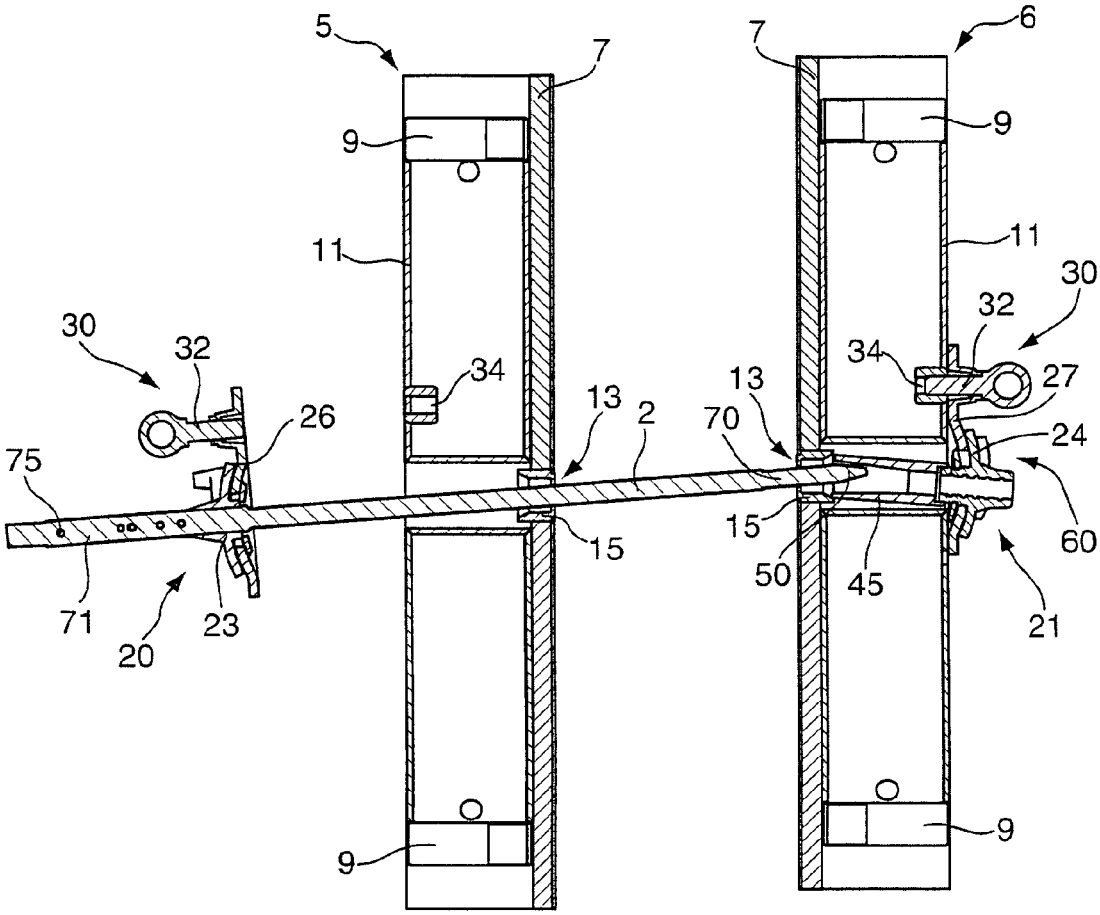
FIG. 2 shows a second phase of implementation of the anchor rod of the inventive anchor system in a cross-section through the inventive anchor system.
Figure 3:
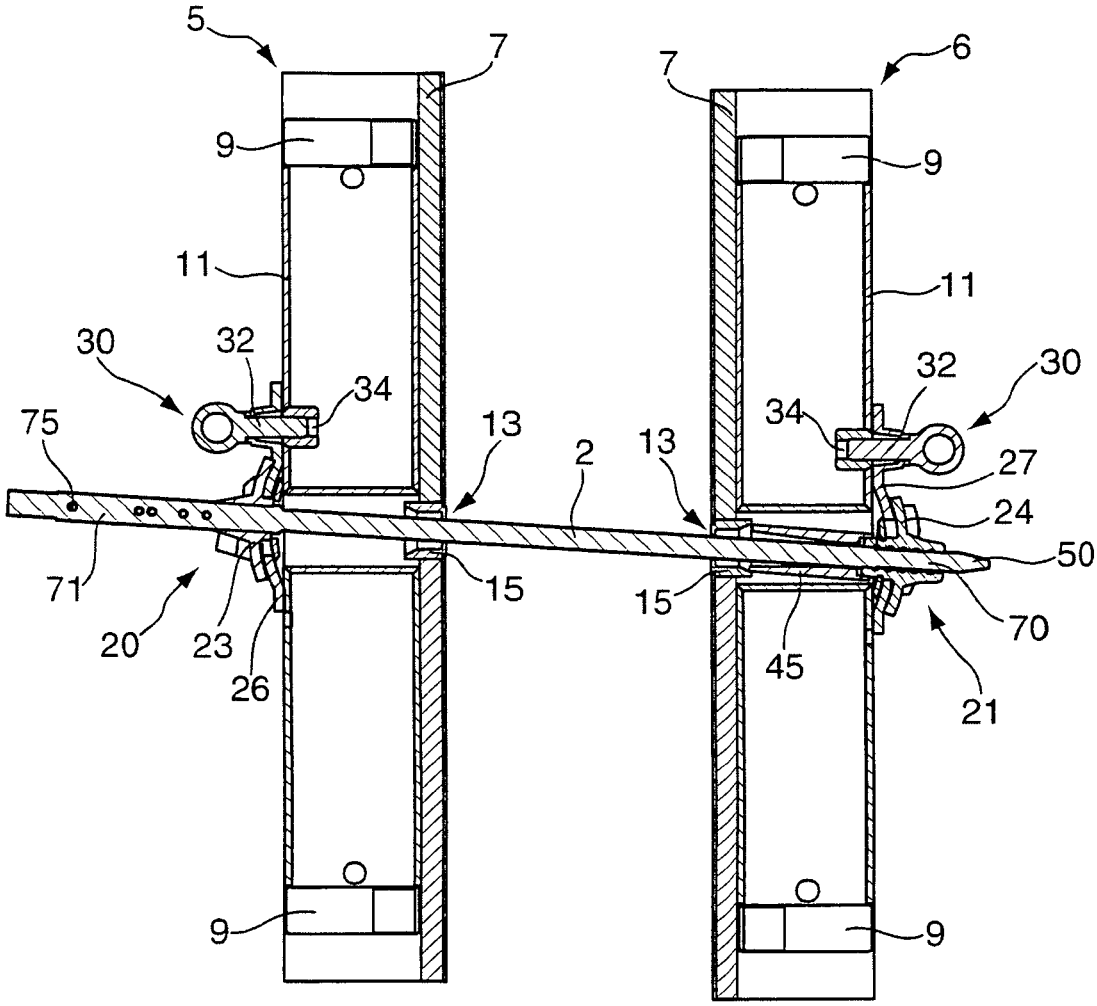
FIG. 3 shows a third phase of implementation of the anchor rod of the inventive anchor system in a cross-section through the inventive anchor system.
Figure 4:
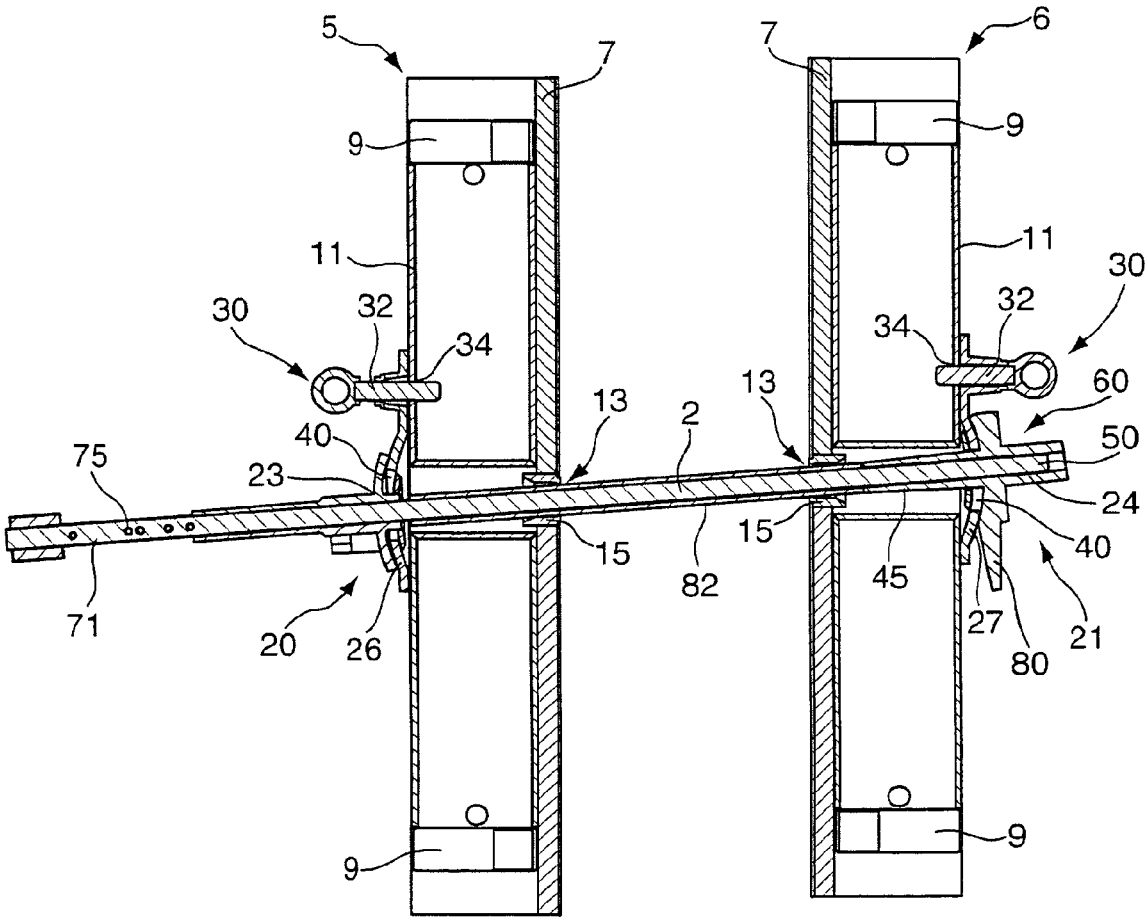
FIG. 4 shows a fourth phase of implementation of the anchor rod of the inventive anchor system in a cross-section through the inventive anchor system.

FIGS. 1 to 4 each show an embodiment of an inventive concrete wall form in various phases of implementation of an anchor rod 2 of an inventive anchor system in a section through the relevant inventive anchor system. Each figure shows a first and a second form element 5,6. The form elements 5,6 each have a formwork shell 7 and longitudinal and tie beams 9, onto which the formwork shell 7 is usually riveted. In each case, the sectional representation extends through a longitudinal beam so that each longitudinal beam is only represented by the wall 11 of the steel section from which the beam is made. The formwork shells 7 of the form elements 5,6 are located opposite each other to form a wall to be cast in concrete. One anchor insertion hole 13 is provided in the formwork shells 7 in the region of each tie beam. The anchor rod 2 is inserted straight from the rear of the first form element 5 through the anchor insertion holes 13 and the tie beam, in whose region the anchor insertion holes 13 are disposed. Seals 15 are disposed in the anchor insertion holes 13 that extend around the anchor rod 2 in such a way that, during concrete casting, essentially no liquid can escape through the anchor insertion holes 13. On the rear of each of the form elements 5,6, one inventive locking device 20,21 is positioned in the anchor insertion holes 13. The locking devices 20,21 each have a screw nut element 23,24 with a screw thread, that is, a hole with an internal thread, through which the anchor rod 2 is screwed. The locking devices 20,21 also each have a dome plate 26,27 with fastening elements 30 for fastening the dome plate 26,27 and therefore the locking device 20,21 on the rear of each one of the form elements 5,6. The fastening elements 30 are constituted by a hole in the edge region of the dome plate 26,27, through which a screw bolt 32 can be or is screwed into a screw hole 34 on each longitudinal beam. Clamps, bayonet connectors, and similar fixtures are also conceivable as technically equivalent fastening elements 30. The dome plate 26,27 is made of a steel plate. It has a spherically formed plate section, that is, a plate section formed as a spherical cup region, in which an opening is provided. The concave surface of the dome plate 26,27 is disposed with radial play around its entire circumference toward the formwork shell 7 of each form element 5,6. The screw nut element 23,24 of each locking device 20,21 is positioned in the opening. A radial groove around the entire circumference is provided on each screw nut element 23,24 that constitutes a receptacle 40 in which the edges of the opening in the spherical plate section of the associated dome plate 26,27 are held. The receptacle 40 has a shape corresponding to the spherical plate section so that, within the radial play, deflection of the screw nut element 23,24 is possible around the entire circumference on the dome plate 26,27, guided by the dome plate 26,27. The groove can, for example, be constituted by plugging or screwing a ring 41 constituting the groove wall on the concrete form side onto a tubular region of a part of the screw nut element 23,24 formed as a domed cap nut 42. A tubular guidance facility 45 aligned with the thread of the screw nut element 24 (for example, a sleeve-like prolongation, that is constituted on the screw but element 24), which has a conically progressing net cross-section, is provided on the inventive locking device 21 positioned on each second form element 6, at the end of the screw nut element 24 disposed on the concrete form side. The interior surface of this guidance facility 45 is shaped like a funnel with an angle of aperture so that it is used as guidance when inserting an anchor rod 2 as shown in FIG. 2. The opening of the guidance facility 45 extends approximately up to the seal 15 in the associated anchor insertion holes 13 of the corresponding formwork shell 7, so that an anchor rod 2 whose tip 50 is guided through the associated seal 15, is directly inserted into the guidance facility 45, which is molded onto the domed cap nut 42 as a single part. The pivot point (circle center), around which the domed cap nut 42 can be swiveled, deflected, or displaced when an anchor rod 2 is inserted, is therefore located in the region of the plane of the formwork shell 7. Furthermore, one anti-rotation lock 60 each is provided on the screw nut elements 23,24 of the locking devices 20,21, which are on the rear of the second form elements 6, that is, those form elements 6, through which the anchor rods 2 are inserted from the front, that is, from the formwork shell 7. These anti-rotation locks 60 are constituted such that an outer region of the screw nut elements 24 during rotation of each screw nut element 24 can abut against a stop constituted, for example, by the fastening elements 30 of the associated dome plate 27, so that the screw nut element 24 cannot turn further. The anchor insertion holes 13 of the form elements 5,6 of the concrete wall form in FIGS. 1 are disposed opposite each other in such a way that they are aligned. This means that the screw nut elements 23,24 are centrically positioned in the associated openings in the dome plates 26,27. The anchor rod 2 is screwed in completely in FIG. 1. The screw thread 70 of the anchor rod 2 therefore has, in the region of the tip 50 of the anchor rod 2, a smaller diameter than the remaining anchor rod 2, thus forming a stop at the transition of the screw thread 70 to the rest of the anchor rod 2. This determines the screw-in depth of the screw thread 70 in the region of the tip 50 of the anchor rod 2 into the screw nut element 24 of the associated locking device 21. The diameter of the screw thread 71 in the region of the end of the anchor rod 2 facing way from the anchor tip is therefore greater than the diameter of the screw thread 70 in the region of the tip 50 of the anchor rod 2. It further follows that the screw thread of the locking device 20 positioned on the rear of the first form element 5, from which the anchor rod 2 is inserted, has a larger diameter than the screw thread of the locking device 21 on the rear of the second form element 6. The illustrated anchor rods 2 also have, on their end regions facing away from the tip 50 of each anchor rod, onto which the locking devices 20 fastened on the rear of the first form element 5 are screwed, splint holes 75 for inserting locking splints. The wall thickness of the concrete wall to be cast can be defined by positioning these splint holes 75. To permit the anchor system shown to also accept the compressive forces on the form elements 5,6, which would cause a reduction in the wall thickness of the concrete wall to be cast, in FIG. 1 a further fastening of the dome plates 26,27 would be necessary on the rear of the form elements 5,6. The latter fastening is provided in FIGS. 2 and 3 by means of screw bolts 32 with molded-on ring's. The anchor rods 2 have, in their regions to be positioned between the formwork shells 7, a shape that conically tapers toward the relevant anchor tip 50, making the anchor rods 2, in particular, if they have been treated or oiled before application in the concrete wall form, easier to remove after the cast concrete wall has cured. The anchor insertion holes 13 of the form elements 5,6 of the concrete wall forms in FIGS. 2 to 4 are not disposed opposite each other in such a way that they are aligned. The screw nut elements of the locking devices 20,21 are therefore not disposed centered in the openings of the spherical plate regions of the associated dome plates. The screw nut elements are instead deflected radially over the surfaces of the spherical regions of the dome plates guided by the associated dome plates, so that the anchor rods 2 are not aligned perpendicularly to the formwork shells 7 of the form elements 5,6.

FIG. 2 shows, how the tip 50 of the anchor rod 2, after insertion through the anchor insertion hole 13 of the second form element 6, enters the tubular guidance facility 45 of the locking device 21 fastened on the rear of the second form element 6 and how the anchor rod 2 is guided by the guidance facility 45 to the screw thread of the associated screw nut element.

In the embodiment of the locking device fastened on the rear of the second form element 6 in FIG. 4, the anti-rotation lock 60 is constituted as a sort of wing 80 at some distance from the screw nut element, so that a stop further away from the screw nut element can prevent rotation of the screw nut element when the anchor rod 2 is screwed in. The anchor rod 2 in FIG. 4 has a continuous screw thread along its entire length. The latter makes it necessary to sheath the anchor rod 2 in a conical plastic layer 82 before application in the concrete wall form at least in the region of the anchor rod 2 subsequently to be encased in concrete, so that the anchor rod can be removed again after the concrete wall has cured.

A locking device 20,21 is proposed for an anchor rod 2 of an anchor system of a concrete wall form, with a screw nut element 23,24 for screwing the anchor rod 2 through a screw thread of the screw nut element 23,24. Therein, a dome plate 26,27 is provided that can be fastened to a back of a form element 5,6 of the concrete wall form by means of fastening elements 30 and a spherically formed plate section having an opening, in which the screw nut element 23,24 is arranged so as to have radial play, wherein the screw nut element 23,24 has a groove-type radial receptacle 40, which accommodates the edges of the opening in the spherical plate section.

The invention is not restricted to the embodiments stated above. A number of variations are conceivable that make use of the characteristics of the invention in embodiments implemented in fundamentally different ways.

I claim:

1. A locking device of an anchor system for concrete wall form elements, the anchor system having an anchor rod with an outer thread, the device comprising:

a fastening element cooperating with a back of a form element;

a dome plate cooperating with said fastening element to fasten said dome plate to the back of the form element, said dome plate having a spherically shaped plate section defining an opening;

a screw nut element having an inner opening with a screw thread for cooperation with the outer thread of the anchor rod, said screw nut element being disposed in said opening of said spherical plate section with radial play, said screw nut element defining a receptacle structured as a radial groove around an entire circumference thereof, said radial groove accepting edges of said spherical plate section opening; and a tubular guidance facility aligned with said screw thread of said screw nut element and disposed at an end of said screw nut element facing a form element.

2. The locking device of claim 1, wherein said tubular guidance facility ends proximate to a formwork shell of the form element.

3. The locking device of claim 1, wherein said screw nut element has an anti-rotation lock.

4. The locking device of claim 3, wherein said anti-rotation lock has a stop element, wherein said stop element prevents rotation of said screw nut element by abutting against a stop.

5. The locking device of claim 4, wherein said stop element is a wing.

6. The locking device of claim 4, wherein said stop element is constituted by said fastening element.

7. An anchor system for a concrete wall form, the anchor system comprising two locking devices of claim 1, wherein said anchor rod is screwed into said screw threads of said screw nut elements of the two locking devices.

8. The anchor system of claim 7, wherein said anchor rod tapers toward an anchor rod tip, wherein a first screw thread in an end region of said anchor rod facing away from said anchor rod tip has a larger thread diameter than a second screw thread in an end region of said anchor rod near to the anchor rod tip.

9. The anchor system of claim 8, wherein said anchor rod conically tapers between said first and said second screw threads.

10. A concrete wall form comprising at least one anchor system of claim 8, wherein the concrete wall form has a first and a second form element and wherein the form elements are opposite each other with formwork shells thereof, a first locking device of said anchor system being disposed on a rear of said first form element and a second locking device of said anchor system being disposed on a rear of said second form element, wherein said anchor rod of said anchor system, coming from a rear of said first form element, is screwed through said screw thread of said screw nut element of said first locking device and, guided through one anchor insertion hole in each of said formwork shells, and then screwed into said screw thread of a screw nut element of said second locking device.

11. The concrete wall form of claim 10, wherein said tubular guidance facility of said second locking device ends near a formwork shell of a form element.

12. The concrete wall form of claim 10, wherein said second screw thread of said anchor rod of said anchor system is screwed completely into said screw nut element of said second locking device of said anchor system as far as it will go and said screw nut element of said first locking device of said anchor system is pre-positioned by means of a locking splint inserted through a splint hole in said anchor rod.

* * * * *